United States Patent [19]

Bergeron

[11] 4,392,550

[45] Jul. 12, 1983

[54] SCAFFOLDING ARRANGEMENT

[76] Inventor: Gaetan G. Bergeron, P.O. Box 1324, Assiniboia, Saskatchewan, Canada

[21] Appl. No.: 257,328

[22] Filed: Apr. 24, 1981

[51] Int. Cl.[3] ..... E04G 1/18; E04G 3/04

[52] U.S. Cl. ..... 182/82; 182/145

[58] Field of Search ..... 182/82, 145, 146, 117, 182/230, 178, 179

[56] References Cited

U.S. PATENT DOCUMENTS

| | | | |
|---|---|---|---|
| 727,407 | 5/1903 | Murphy | 182/145 |
| 2,549,212 | 4/1951 | Lane | 182/82 |
| 2,966,957 | 1/1961 | Ireland | 182/117 |
| 3,198,470 | 8/1965 | Owens | 182/230 |
| 4,238,000 | 12/1980 | Nyman | 182/82 |

FOREIGN PATENT DOCUMENTS

| | | | |
|---|---|---|---|
| 2014638 | 8/1979 | United Kingdom | 182/82 |

*Primary Examiner*—Reinaldo P. Machado

*Attorney, Agent, or Firm*—Stanley E. Johnson; Richard J. Hicks

[57] ABSTRACT

A scaffolding generally of the type for use in placing siding on a vertical wall of a house wherein the scaffolding has two posts disposed vertically and supported at the lower end by a support structure offset from the post in a direction away from the house and having legs offset from one another in a direction parallel to the wall of the house.

7 Claims, 6 Drawing Figures

SCAFFOLDING ARRANGEMENT

This invention relates to improvements in scaffolding and particularly scaffolding for use in working at elevated positions on the wall of a building such as, for example, while installing siding and/or painting the side of the house or soffit and/or repairing the latter.

The invention is particularly concerned with the supporting structure for scaffolding and scaffolding incorporating such supporting structure.

Scaffolding of the general type to which the present invention relates is disclosed in Canadian Pat. No. 434,677 issued May 14th, 1948. The scaffolding disclosed in such patent includes a pair of vertical posts that lean against the building, the lower end resting on the ground and adjacent the other end bearing against the fascia of the building. Lateral stability of the scaffolding depends upon frictional engagement of the posts with the fascia and this can be increased by increasing the slope of the posts. Sloping posts, however, are undesirable as they do not maintain the worker at the same distance from the building for the different vertical positions at which he may be working. To overcome this, one could place the posts more vertically but this is unsafe because of loss of stability. Also, with the posts sloping one may become careless in using the scaffolding because familiarity gained at one elevation, with respect to the working distance from the wall, does not apply at a higher or lower elevation.

Another scaffolding structure known (Canadian Pat. No. 741,706 issued Aug. 30th, 1966) wherein the base structure for the vertical posts have bases that extend longitudinally parallel to the wall of the building for increasing lateral stability of the structure.

An object of the present invention is to provide a support structure for posts of the scaffolding type illustrated in Canadian Pat. No. 434,677 and arranged so as to provide lateral support for the scaffolding and at the same time ensure there is firm pressural contact with the fascia of the building while having the posts parallel to the wall on which the worker is working.

The invention is illustrated by way of example in the accompany drawings wherein.

Figure 2:
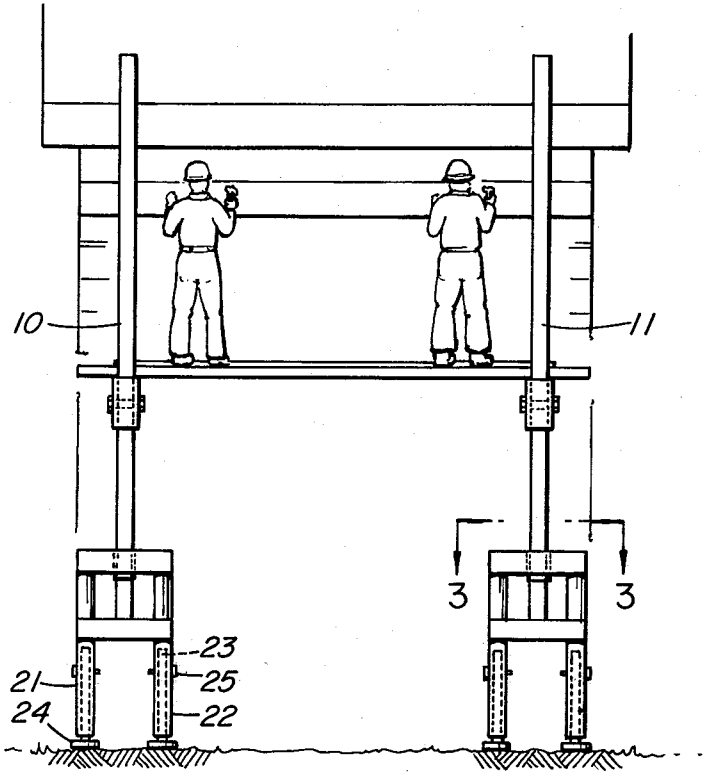
FIG. 2 is a right-hand elevational view of FIG. 1.

Referring now to the drawings, there is illustrated a pair of spaced apart vertical posts 10 and 11 parallel to one another and parallel to the wall 12 of a building on which workers are placing siding. Each post 10 and 11 bears against the fascia 13 of the building. Slidably mounted on each post is a bracket 14 which may be retained at any elevated position by suitable means as, for example, by one or more pins 15 passing through apertures in the bracket and aligned with an aperture in the post. A strut 16 on the bracket 14 projects forwardly from the post towards the building and on which one or more planks 17 are placed providing a platform for the workers adjacent the wall on which they are working.

Each post 10 and 11 is supported at the lower end by a support structure identified generally by the reference

20. The support structure 20 has a pair of vertical legs 21 and 22 offset from one another in a direction parallel to the building and offset from the vertical post in a direction away from the wall of the building. Posts 21 and 22, for example, may be pipes, one or both of which may optionally have telescopically mounted in the lower end thereof a pipe or rod member 23. Member 23 preferably has a foot pad 24 on the lower end to minimize or prevent sinking when used on soft ground. Members 23 can be locked at the various vertical positions in any convenient manner (relative to the leg associated therewith) by, for example, a pin 25 passing through aligned apertures in the leg and member 23.

Figure 4:
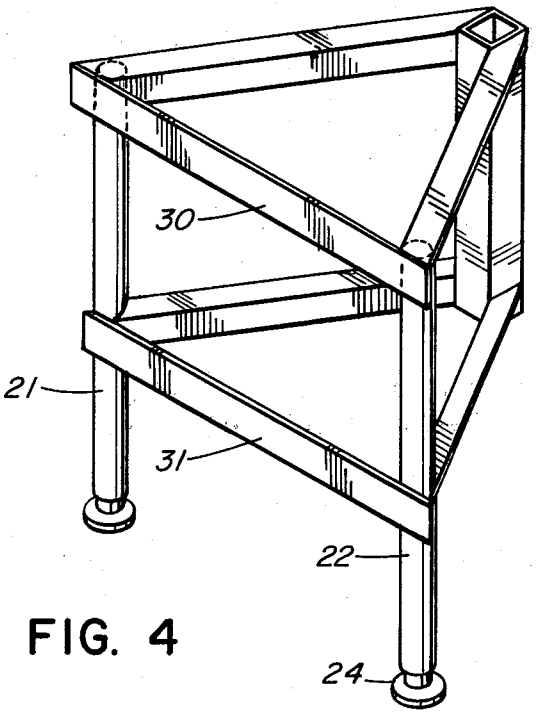
FIG. 4 is an oblique view of one scaffolding post support incorporating a minor modification.
Figure 3:
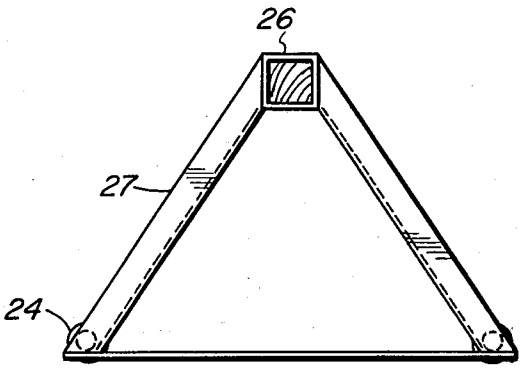
FIG. 3 is a top view of one support taken along essentially line 3—3 of FIG. 2.

The vertical legs 21 and 22 are connected to an open ended box section 26 by an upper pair of members 27 and a further box section 28 by a lower pair of members 29. Box sections 26 and 28, of course, may be a single member (see FIG. 4). Members 27 and 29 are preferably angle irons disposed horizontally, when the post it is supporting is vertical, with horizontal flanges on the top side. In place of box sections 26 and 28 the upper and lower pair of members 27 and 29 may be securely attached directly to the post. One advantage of utilizing a box section is that the post can be slidably mounted therein and retained at any vertical position by pin connections or bolts. The posts thus can be lowered to a position where the bottom end is near the ground (see post projecting portion 30 in FIG. 1). This is a safety feature in the off-chance there may be partial failure of the support 20.

In having the upper surfaces of the pairs of members 27 disposed horizontally the supports can be used as work benches by the workers or as a place to store their materials being used. Also, one or more planks can extend across from one support to the other providing a work bench. Similarly, one or more planks may be placed on the lower pair of supports 29 providing a shelf for the workman's tools. To further rigidify the post support structure, legs 21 and 22 can be interconnected by respective upper and lower rigid members 30 and 31.

While the post support illustrated and described is made of metal, other suitable structural materials, for example wood, may be used in place thereof. Also, the box sections 26 and 28 may be replaced by U-shaped or channel sections in which case bolts or other suitable clamping means would be used to securely anchor the post to the channel member. As a further modification, the bracket 14 could be jackably mounted (i.e. ratchet and pawl) on the post permitting the workers to raise and lower the platform while standing on the same.

Figure 1:
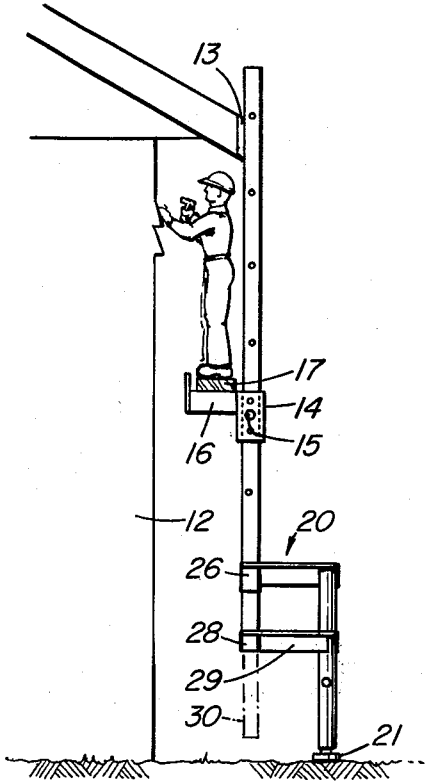
FIG. 1 is a side elevational view of a scaffolding provided in accordance with the present invention.
Figure 5:
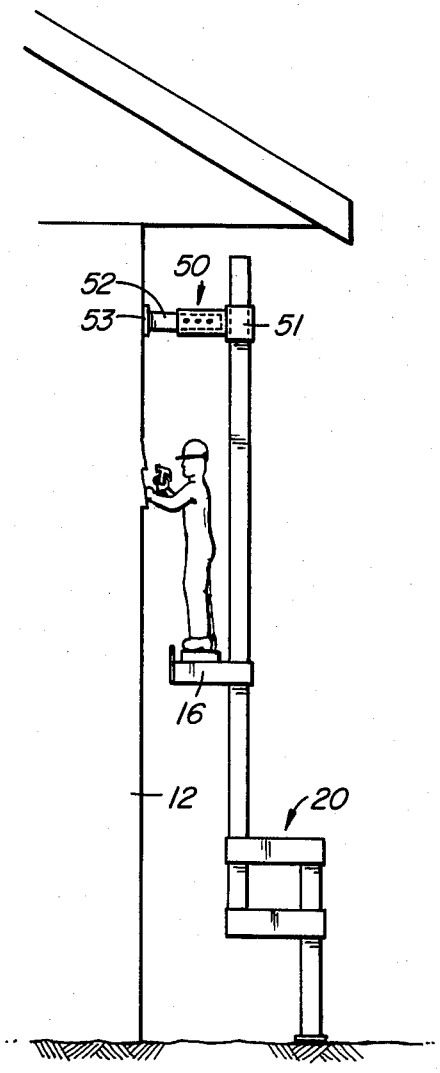
FIGS. 5 and 6 are similar to FIG. 1 illustrating further minor modifications.
Figure 6:
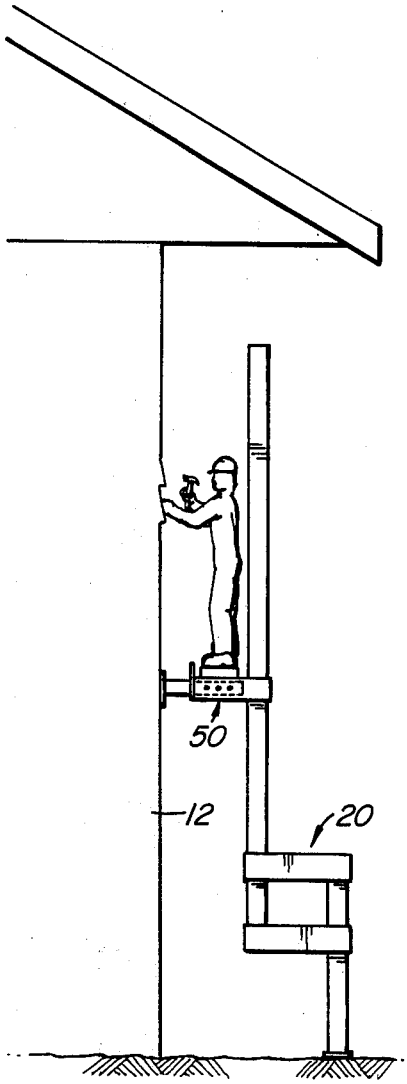

The vertical posts normally would be in engagement with the fascia as illustrated in FIGS. 1 and 2. However, in some instances the roof overhang may result in having the vertical posts too far from the wall for the workers. To overcome this difficulty there is illustrated in FIGS. 5 and 6 adjustable brackets secured to the vertical posts and engagable with the vertical wall of the building. Referring to FIG. 5, there is illustrated a telescopic bracket 50 located adjacent the upper end of the vertical post. The telescopic bracket has a first portion 51 secured to the post and a second portion 52 adjustably mounted in the bracket 51 and with a foot-pad 53 for engaging the wall of the building. The member 52 is screw-threaded into member 51 but it may be made adjustable in any other convenient means such as, for example, a pin insertable through aligned apertures in the members 51 and 52. As illustrated in FIG. 6 the adjustable bracket 50 provides the combined function of engaging the wall of the building and providing a bracket for supporting the workers' platform in place of struts 16 illustrated and described with reference to FIG. 1.

I claim:

1. A scaffold structure comprising:

(a) a pair of vertical posts;

(b) a pair of brackets, said brackets being slidably mounted on respective ones of said posts and each having a strut projecting therefrom to support a platform;

(c) means to lock the brackets on the respective posts at various selected vertical positions; and (d) support secured to each post adjacent the lower end thereof such that the bottom end of the post is out of contact with the ground, each said support comprising a pair of legs offset from one another in a first plane wherein said plane is offset from the post and means rigidly connecting each of said legs to the post associated therewith, said connecting means comprising an upper and lower pair of rigid members connected at one end to an open ended box section in which the post is securely fastened and at the other end rigidly secured to said legs.

2. A scaffold structure as defined in claim 1 wherein said upper pair of rigid members are disposed in a horizontal plane when the post associated therewith is vertical.

3. A scaffold structure as defined in claim 2 wherein the upper pairs of rigid members of the two supports are in substantially the same horizontal plane.

4. A scaffold structure as defined in claim 1 including means to adjustably vary the length of at least one of the legs of each support at the lower end.

5. A scaffold structure as defined in claim 1 including brace means interconnecting the pair of legs of each support.

6. A scaffold structure as defined in claim 1 wherein the struts projecting from the respective brackets are adjustably variable in length.

7. A scaffold structure for supporting workmen adjacent a vertical wall comprising:

(a) a pair of vertical posts;

(b) a pair of brackets, said brackets being slidably mounted on respective ones of said posts and each having a strut projecting therefrom in a direction toward the wall and supporting a platform for the workmen;

(c) means to lock the brackets on the respective posts at various selected vertical positions; and (d) a support secured to each post adjacent the lower end thereof such that the bottom end of the post is out of contact with the ground, each said support comprising a pair of legs offset from one another in a first plane substantially parallel to the wall and wherein said plane if offset from the post in a direction away from the wall and means rigidly connecting each of said legs to the post associated therewith, said connecting means comprising an upper pair and a lower pair of rigid members each connected at one end to an open ended box section in which the post is securely fastened and at the other end secured to respective ones of the pair of legs.

* * * * *